US008263913B2

(12) United States Patent
Takeuchi

(10) Patent No.: US 8,263,913 B2
(45) Date of Patent: Sep. 11, 2012

(54) DEVICE EQUIPPED WITH PLANAR HEATER

(75) Inventor: Kesatoshi Takeuchi, Shiojiri (JP)

(73) Assignee: Seiko Epson Corporation (JP)

( * ) Notice: Subject to any disclaimer, the term of this patent is extended or adjusted under 35 U.S.C. 154(b) by 365 days.

(21) Appl. No.: 12/077,183

(22) Filed: Mar. 17, 2008

(65) Prior Publication Data

US 2008/0237219 A1 Oct. 2, 2008

(30) Foreign Application Priority Data

Mar. 29, 2007 (JP) ..... 2007-86811

(51) Int. Cl.

| | |
|---|---|
| ***H05B 3/12*** | (2006.01) |
| ***H05B 3/18*** | (2006.01) |
| ***H05B 3/28*** | (2006.01) |
| ***H05B 3/84*** | (2006.01) |

(52) U.S. Cl. ..... 219/505; 219/203; 219/219; 219/541

(58) Field of Classification Search ..... 219/522, 219/203, 213, 219, 505, 528, 535, 538, 547; 338/25

See application file for complete search history.

(56) References Cited

U.S. PATENT DOCUMENTS

| | | | | |
|---|---|---|---|---|
| 3,790,748 | A * | 2/1974 | Van Laethem et al. | 219/219 |
| 4,939,348 | A * | 7/1990 | Criss | 219/547 |
| 4,940,884 | A * | 7/1990 | Gillery | 219/203 |
| 4,970,376 | A * | 11/1990 | Mellor et al. | 219/543 |
| 5,347,106 | A * | 9/1994 | Reiser et al. | 219/219 |
| 5,493,102 | A | 2/1996 | Takase et al. | |
| 5,750,267 | A | 5/1998 | Takase et al. | |
| 6,392,209 | B1 * | 5/2002 | Oppitz | 219/549 |
| 6,834,969 | B2 * | 12/2004 | Bade et al. | 359/507 |
| 7,106,167 | B2 * | 9/2006 | Parsons | 338/25 |

FOREIGN PATENT DOCUMENTS

| | | |
|---|---|---|
| JP | 02-033882 | 2/1990 |
| JP | 06-338381 | 12/1994 |
| JP | 2001-326060 | 11/2001 |
| JP | 2003-272807 | 9/2003 |

* cited by examiner

*Primary Examiner* — Joseph M Pelham

(74) *Attorney, Agent, or Firm* — Harness, Dickey & Pierce, P.L.C.

(57) ABSTRACT

The planar heater includes an insulating substrate, an electric conductive film disposed on the substrate, a plurality of electrodes both attached to one side of the electric conductive film, and an insulating film covering the electric conductive film. The electric conductive film is preferably formed of material having a resistance temperature coefficient of 420 ppm/° C. or higher at normal temperature.

4 Claims, 7 Drawing Sheets

| Metal | Resistance $\rho$ ($\mu\Omega$-cm) | Resistance temperature coefficient $\alpha$ (ppm/°C) | Melting point (°C) |
|---|---|---|---|
| Tungsten W | 5.5 | 450 | 3410 |
| Molybdenum Mo | 4.8 | 460 | 2620 |
| Titanium Ti | 55.4 | 420 | 1660 |
| Zirconium Zr | 40 | 440 | 1850 |
| Nickel Ni | 7.2 | 670 | 1450 |
| Copper Cu | 1.7 | 70 | 1080 |
| Aluminum Al | 2.7 | 420 | 660 |

Fig.6A
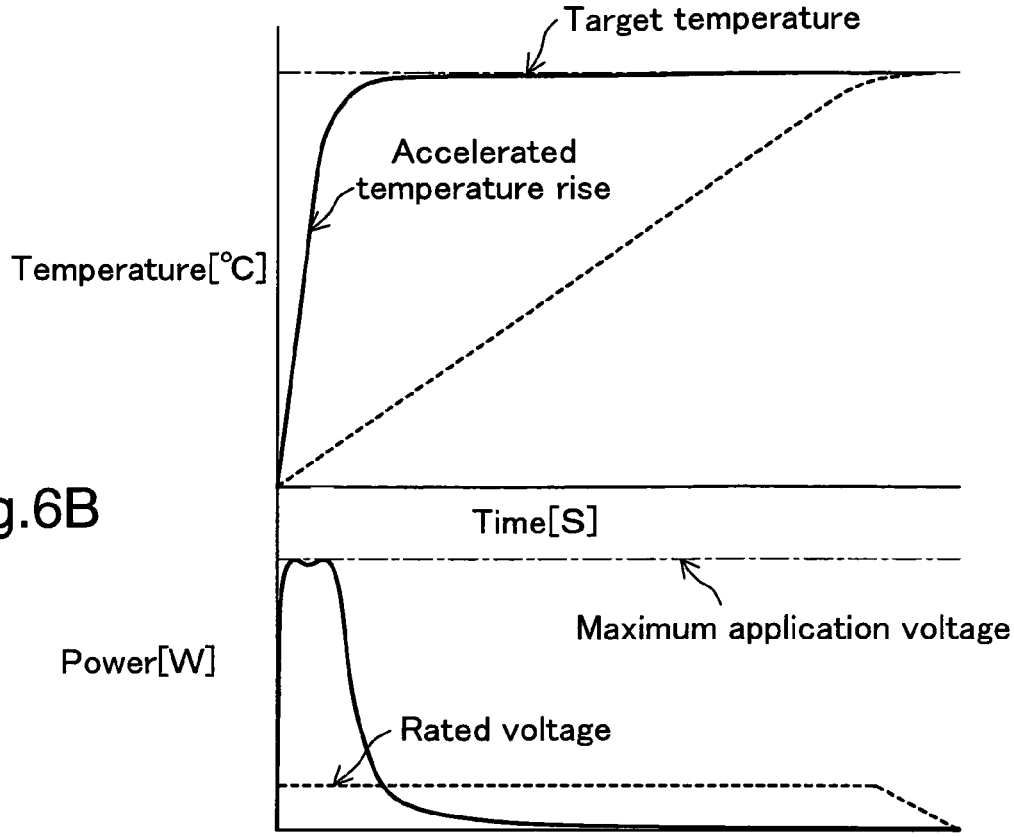
Fig.6B
Fig.7A
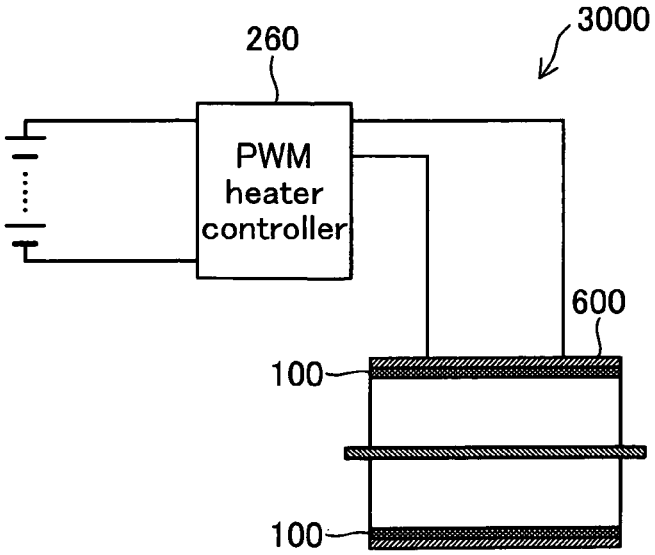
Fig.7B
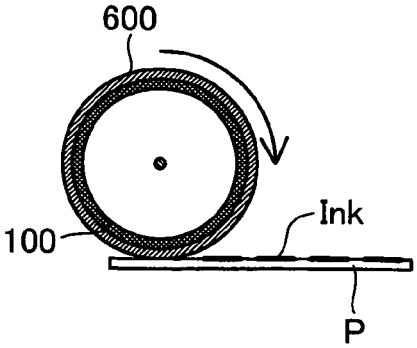

DEVICE EQUIPPED WITH PLANAR HEATER

CROSS-REFERENCE TO RELATED APPLICATIONS

The present application claims the priority based on Japanese Patent Application No. 2007-86811 filed on Mar. 29, 2007, the disclosure of which is hereby incorporated by reference in its entirety.

BACKGROUND OF THE INVENTION

1. Field of the Invention

The present invention relates to a device equipped with a planar heater.

2. Description of the Related Art

One example of a planar heater is disclosed in JP2001-326060A.

FIG. 11 is an illustration depicting a conventional planar heater. This planar heater has electrodes 1110, 1120 disposed on opposite sides of a heating element 1100; during heating, electrical current flows in one direction (indicated by the arrows) between the electrodes 1110, 1120. In a different structure, a planar heater has a nichrome wire disposed in a serpentine path over the heating surface.

Conventional planar heaters such as these tend to give rise to bias in temperature distribution, making uniform heating difficult in some instances. Since the placement of the electrodes or terminals is determined in a manner dependent on the shape and structure of the heating element, a resultant problem is low flexibility in terms of selecting terminal placement.

SUMMARY OF THE INVENTION

An object of the present invention is to provide technology capable of reducing bias in temperature distribution of a planar heater to a level lower than in the prior art.

According to an aspect of the present invention, there is provided a device comprising a planar heater. The planar heater includes: an insulating substrate; an electric conductive film disposed on the substrate; a plurality of electrodes both attached to one side of the electric conductive film: and an insulating film covering the electric conductive film. The electric conductive film is formed of material having a resistance temperature coefficient of 420 ppm/° C. or higher at normal temperature.

In this device, since the electric conductive film of the planar heater is formed of material having a resistance temperature coefficient of 420 ppm/° C. or higher at normal temperature, appreciable flow of electrical current does not take place in portions of the electric conductive film that are at relatively high temperature, and electrical current becomes concentrated in portions at low temperature. It is consequently possible to reduce bias in temperature distribution of a planar heater to a level lower than in the prior art.

The electric conductive film is preferably formed of material having resistance of 4.8 μΩ-cm or higher at normal temperature.

With this design, since the electric conductive film is formed of material having relatively high resistance, it is possible to achieve satisfactory functionality as a heating element, without the electric conductive film having to be very thin.

The electric conductive film may be formed of tungsten.

Since tungsten has a high melting point, the effect discussed above will be sustained up to relatively high temperature.

The planar heater may be made transparent.

With this design, the planar heater can be used in components of which light transmission is required, such as windows.

The present invention may take any of various embodiments, such as planar heater; devices of various kinds equipped with a planar heater; and so on.

BRIEF DESCRIPTION OF THE DRAWINGS

FIGS. 6A and 6B show temperature control using a PWM heater controller:

FIGS. 7A and 7B show the configuration of a fuser drum unit for a printer, pertaining Embodiment 3 of the invention;

DESCRIPTION OF THE PREFERRED EMBODIMENT

Figure 1A:
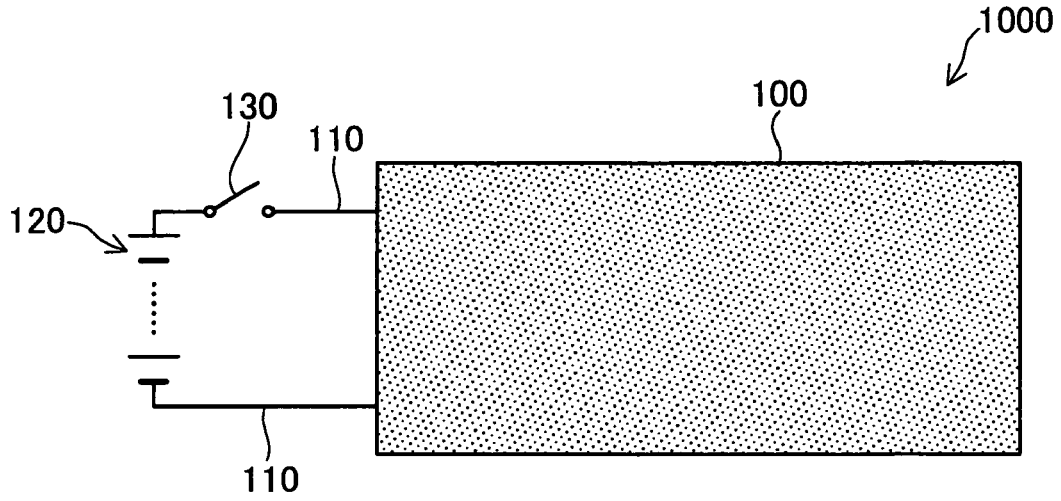
FIGS. 1A and 1B show the configuration of a planar heater pertaining to Embodiment 1 of the invention.
Figure 1B:
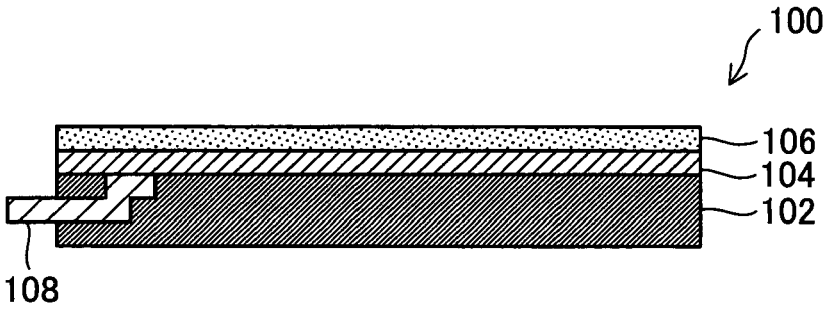

FIG. 1 is an illustration depicting the configuration of a heating device pertaining to a first embodiment of the present invention. This heating device 1000 includes a planar heater 100, two lead wires 110, a power supply 120, and a switch 130. FIG. 1B depicts the planar heater 100 in cross section. The planar heater 100 has an insulating substrate 102; an electric conductive film 104 disposed on the substrate 102; and an insulating film 106 disposed so as to cover the electric conductive film 104. In this example, the electric conductive film 104 is rectangular in shape and is provided with two electrodes 108 in proximity to either edge of one side of the film 104 for connection to the lead wires 110.

The substrate 102 may be formed from any insulating material; for example, it may be formed of quartz glass. The electric conductive film 104 functions as the heating element, and as will be discussed later may be formed from various materials such as tungsten. The electric conductive film 104 may be formed through vapor deposition onto the substrate 102. It is possible for the insulating film 106 to be composed of various types of insulating thin film, such as silicon oxide film or silicon nitride film, for example. The insulating film 106 may also be produced through vapor deposition.

In preferred practice, the heat capacity of the layers 102, 104, 106 will be sufficiently small to enable the planar heater 100 as a whole to rapidly rise in temperature. Such small heat capacity will be achieved, for example, by minimizing the thickness of each layer. Where the planar heater 100 has been made transparent, it will be possible to utilize the planar heater 100 as a component, such as a window, of which light transmission is required. A transparent planar heater may be obtained, for example, by using transparent electric conductive material to form the electric conductive film 104. It is possible to use various materials such as indium oxide (ITO) based, zinc oxide based, or tin oxide based materials as the transparent electric conductive material. For the planar heater 100 to be deemed "transparent" it will preferably have average transmittance of 80% or above in the visible light range or 400-700 nm wavelength range, for example.

Figure 2A:
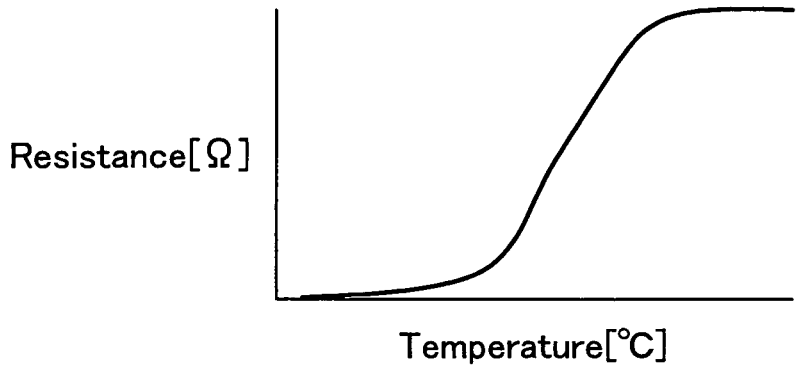
FIGS. 2A-2C show operating status and temperature characteristics of a heating device.

FIG. 2A shows an example of the resistance-temperature characteristics of the electric conductive film 104. Typically, resistance of the electric conductive film 104 increases in association with rising temperature. As will be discussed later, the material of the electric conductive film 104 will preferably have a high resistance temperature coefficient. The resistance temperature coefficient denotes percentage increase in resistance relative to an increase in temperature.

Figure 2B:
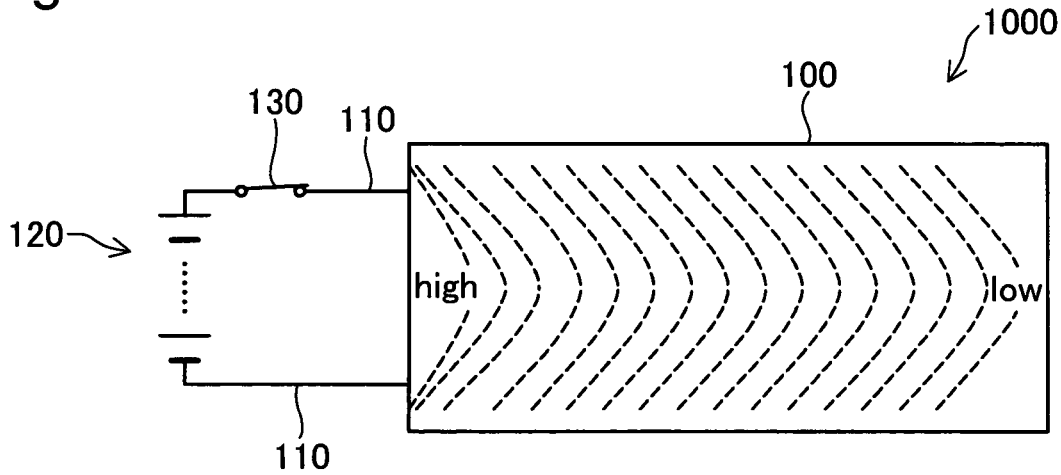

FIG. 2B depicts initial operation of the heating device 1000. The broken lines appearing inside the planar heater 100 in FIG. 2B are isothermal lines. After the switch 130 has been put in the ON state, the majority of the electrical current will flow to the planar heater 100 in the area of the left side thereof where the lead wires 110 are connected, causing temperature to rise in this area. As depicted in FIG. 2A, resistance of the electric conductive film 104 typically increases with rising temperature. Consequently, as the temperature rises in the vicinity of the left side of the planar heater 100, resistance in this area will rise as well, thus producing a relative increase in electrical current flow to other areas, which are areas towards the right from the vicinity of the left side. As this phenomenon continues, eventually the vicinity of the left side, where the lead wires 110 are connected, will reach relatively high temperature, while the area on the opposite side maintains relatively low temperature, as shown in FIG. 2B. However, where the resistance temperature coefficient of the electric conductive film 104 is sufficiently high, the temperature differential between the high temperature portion and the low temperature portion in the planar heater 100 will be kept to a small level which does not cause substantial practical concerns.

Figure 2C:
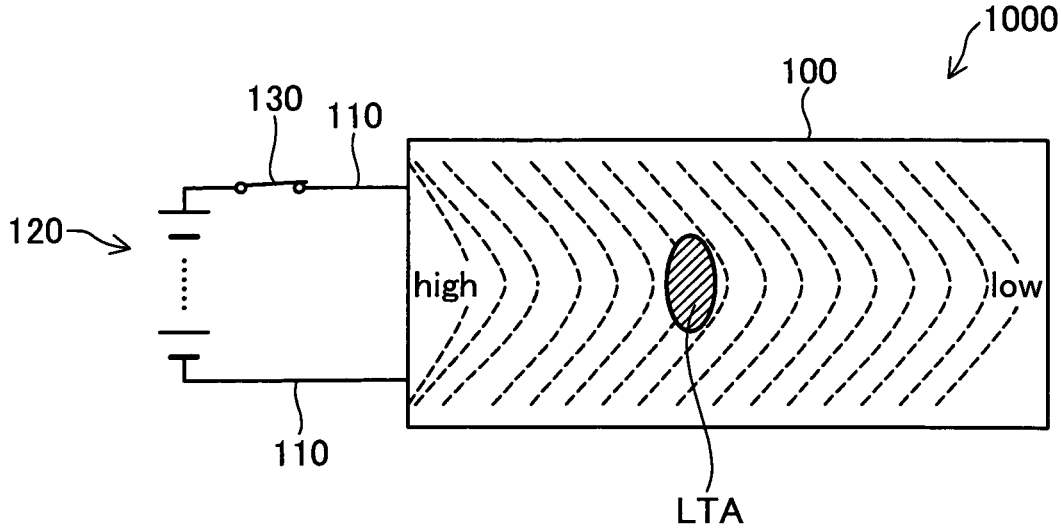

FIG. 2C depicts a condition in which externally-induced cooling in proximity to the center of the planar heater 100 has created a low-temperature area LTA. In this low-temperature area LTA, resistance is lower than in the surrounding high-temperature regions so there will be greater flow of electrical current and greater heat generation. Consequently, even if such a low-temperature area LTA should occur in one region of the planar heater 100, the increased level of heat generation in the area LTA will bring it back into approximation with the average temperature distribution. In this way, due to the high resistance temperature coefficient of the electric conductive film 104, the planar heater 100 will exhibit autonomous reduction of bias in temperature distribution, making possible a highly uniform temperature distribution. The electric conductive film 104 with a high resistance temperature coefficient can be formed of a metal such as tungsten, for example.

Figures 3, 4:
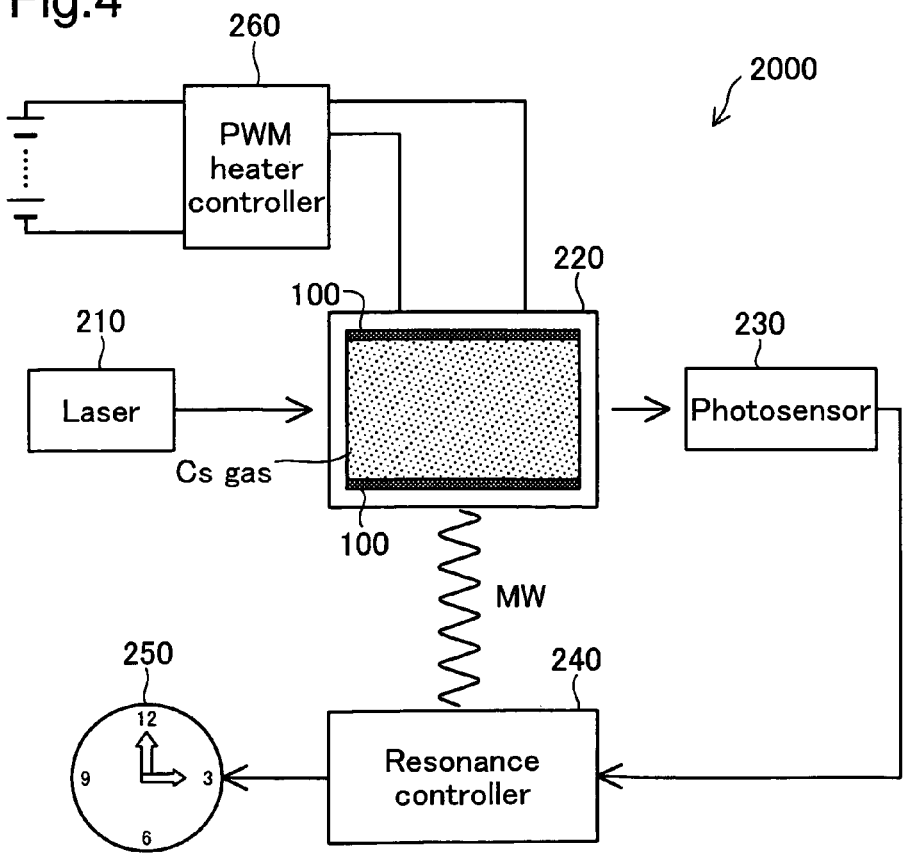
FIG. 3 shows resistance values, resistance temperature coefficients, and melting points of several metals.
FIG. 4 shows the configuration of an atomic clock device pertaining to Embodiment 2 of the invention.

FIG. 3 shows resistance values, resistance temperature coefficients, and melting points of several metals. These characteristic values are values observed at normal temperature of 20° C. Copper, which is typically used for conductive wire, exhibits resistance of 1.7 μΩ-cm, while aluminum exhibits resistance of 2.7 μΩ-cm. Consequently, it is preferable to use a material having higher resistance than copper or aluminum as the electric conductive film 104. By so doing, the electric conductive film 104 will be formed of material having relatively high resistance so that the electric conductive film 104 will function satisfactorily as a heating element despite not being made very thin. In this regard, it is possible to use a metal such as tungsten, molybdenum, titanium, zirconium, or nickel given by way of example in FIG. 3, as the material for the electric conductive film 104. These metals all exhibit resistance of 4.8 μΩ-cm or more at normal temperature, and have sufficiently high resistance relative to copper. Consequently, it is possible to use these metals to constitute the electric conductive film 104 which functions as the heating element. From the standpoint of function as the heating element, it is preferable for the electric conductive film 104 to be made sufficiently thin; e.g. 10 nm to 1,000 nm.

As discussed in relation to FIGS. 2A-2C, it is preferable to use a material having a high resistance temperature coefficient as the material for the electric conductive film 104. In this regard, it is preferable to use a material having a resistance temperature coefficient of 420 ppm/° C. or more. If a high-melting material is used, it will be possible to use the planar heater 100 under higher temperature conditions. In this regard, it is preferable for the electric conductive film 104 to be formed from tungsten.

It is also possible to use alloys or mixtures that contain any of the metals tungsten, molybdenum, titanium, zirconium, nickel, or the like as the material for the electric conductive film 104. It is also possible to use materials other than those listed in FIG. 3. As mentioned previously, it is possible to use a transparent electric conductive material to form the electric conductive film 104, in order to obtain a transparent planar heater.

In the heating device 1000 of Embodiment 1 described above, the heating element (electric conductive film 104) of the planar heater is formed from material having a relatively large resistance temperature coefficient (e.g. 420 ppm/° C. or more), making it possible to reduce bias in temperature distribution in the planar heater. Moreover, since the planar heater has a function of eliminating temperature distribution bias in an autonomous manner, the two terminals may be situated disproportionately towards one side of the heating element as depicted in FIGS. 1A-1B and 2A-2B. In other words, there is the advantage of a high degree of flexibility in selection of the locations for the terminals in the planar heater.

FIG. 4 is an illustration depicting an atomic clock device pertaining to a second embodiment of the present invention. The atomic clock device 2000 includes a laser 210, a cesium gas cell 220, a photosensor 230, a resonance controller 240, a clock display device 250, and a PWM heater controller 260. Cesium gas is sealed within the cesium gas cell 220, and planar heaters 100 are respectively disposed thereabove and therebelow for the purpose of regulating temperature. As is well known, this atomic clock device 2000 employing the cesium gas cell 220 utilizes the fact that, when cesium atoms in the ground state absorb microwaves of specific frequency, they absorb laser light. Specifically, when the cesium atoms are excited by laser light, the laser light used in excitation is absorbed by the cesium atoms, while the laser light that was not used in excitation passes through the cesium gas cell 220 and is detected by the photosensor 230. The resonance controller 240 modulates the frequency of microwaves MW depending on the output of the photosensor 230, and irradiates the cesium cell 220 with the modulated microwaves MW. When the frequency of these microwaves MW matches a specific frequency of the cesium atom (the resonance frequency), the cesium atoms which have absorbed the microwaves MW will absorb the laser light. Since absorptance of laser light in the cesium gas cell 220 reaches its maximum at this time, the output of the photosensor reaches its minimum. The resonance frequency at this time will be a value unique to cesium (9.19 GHz); by timing this resonance frequency and displaying the time on the clock display device 250, it is possible to display the correct time.

In order to increase the accuracy of the atomic clock device 2000, it is desirable to maintain the gas cell 220 at constant temperature. The planar heaters 100 and the PWM heater controller 260 are provided for the purpose of maintaining the gas cell 220 at constant temperature. The planar heater of the present invention is applicable in atomic clock devices other than cesium gas cell type (e.g. rubidium gas cell type).

Figure 5:
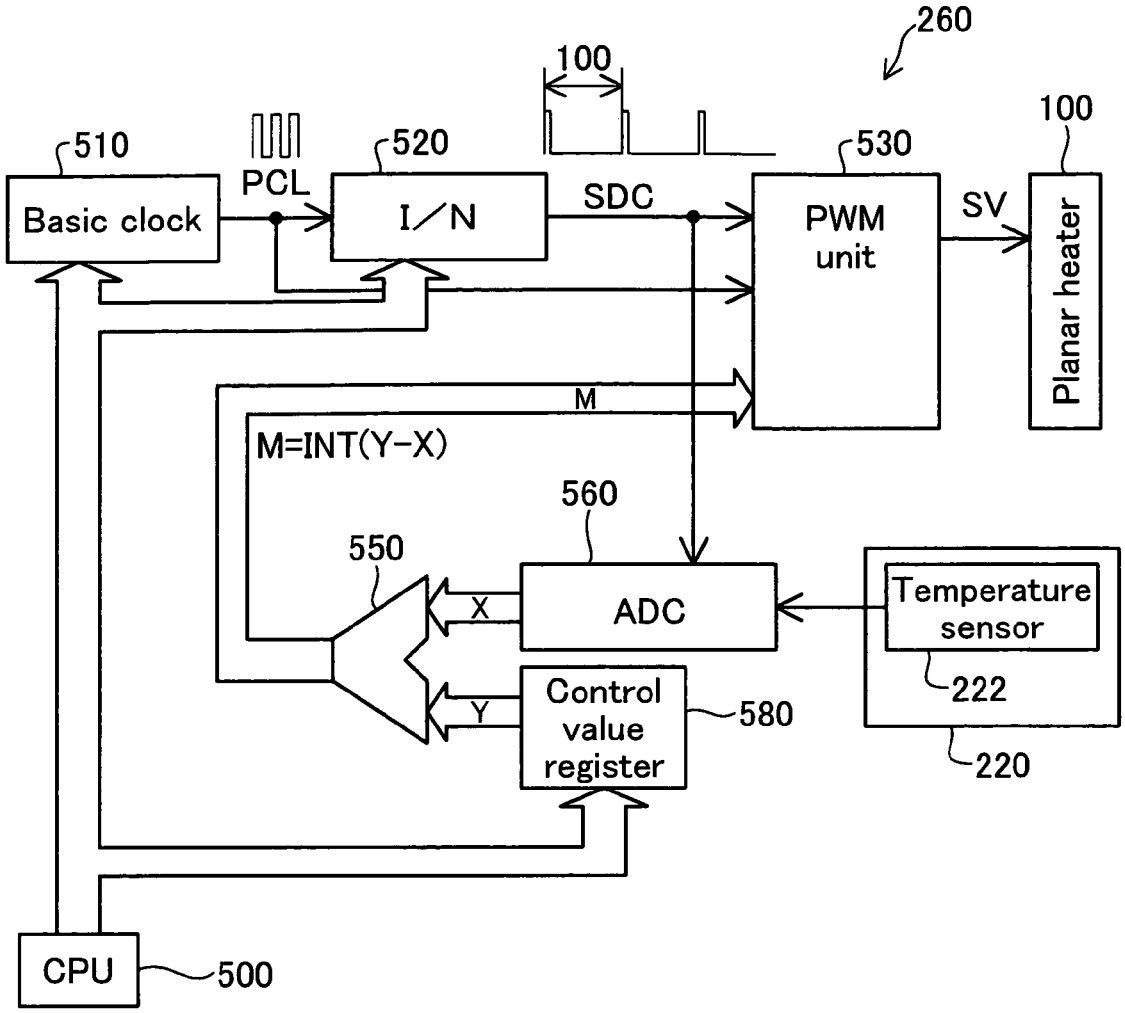
FIG. 5 is a block diagram depicting the internal configuration of a PWM heater controller.

FIG. 5 is a block diagram depicting the internal configuration of the PWM heater controller 260. The PWM heater controller 260 has a CPU 500, a basic clock generating circuit 510, a 1/N frequency divider 510, a PWM unit 530, a subtractor 550, an A/D converter 560, and a control value register 580.

The basic clock generating circuit 510 generates a clock signal PCL of prescribed frequency, and is composed of a PLL circuit, for example. The frequency divider 520 generates a clock signal SDC of a frequency which is 1/N the frequency of the clock signal PCL. The value of N is set to a prescribed constant. This value of N has been previously established in the frequency divider 520 by the CPU 500. In response to the clock signals PCL, SDC, and the output M of the subtractor 550, the PWM unit 530 controls the duty ratio of a voltage signal SV supplied to the planar heaters 100.

The subtractor 550 outputs a value (Y−X) equal to a control value Y provided by the control value register 580, minus the output X of the AD converter 560. The output X of the AD converter 560 is a value derived by AD conversion, in sync with the clock signal SDC, of the output of a temperature sensor 222 provided inside the cesium gas cell 220. The control value Y is pre-established in the control value register 580 by the CPU 500, and indicates target temperature for the planar heaters 100. Consequently, the output M of the subtractor 550 represents the difference between the target temperature Y and the actual temperature X, (Y−X).

The PWM unit 530 is a circuit that, during a single cycle of the clock signal SDC, generates one pulse at a duty factor of M/N; it may be implemented by a comparator, for example. The duty ratio of pulses of the voltage signal SV output by the PWM unit 530 increases with larger temperature differential M. Consequently, a larger temperature differential M will result in greater effective voltage being applied to the planar heaters 100. More specifically, the effective voltage applied to the planar heaters 100 is controlled in a manner proportional to the temperature differential M.

As will be understood from the preceding description, the PWM heater controller 260 performs PWM control of effective voltage to the heaters, on the basis of the differential M of the target temperature Y and the actual temperature X. By carrying out PWM control in this way, the temperature of the cesium gas cell 220 will be quickly and accurately brought to the target temperature, and maintained close to the target temperature.

FIGS. 6A and 6B show temperature control using the PWM heater controller 260 of FIG. 5. FIG. 6A shows an example of temperature change over time; FIG. 6B shows change over time of the voltage of the planar heater 100. As the rated power of the planar heater 100 rises relatively gently as indicated by the broken line in FIG. 6B, temperature will also rise relatively gently as indicated by the broken line in FIG. 6A. On the other hand, through PWM control of the planar heater 100 using the PWM heater controller 260, the voltage applied to the planar heater 100 will vary proportionally with the temperature differential, as indicated by the solid line in FIG. 6B. Specifically, where the temperature differential is large, the heater will be supplied with voltage up to the maximum application voltage; and as the temperature differential becomes smaller, the application voltage will accordingly drop sharply. As a result, cell temperature will quickly be brought to the target temperature, as shown by the solid line in FIG. 6A. Even after reaching the target temperature, the cell will be maintained close to the target temperature through PWM control depending on the temperature differential.

FIGS. 7A and 7B show the configuration of a fuser drum unit for printer use, pertaining to a third embodiment of the present invention. This fuser drum unit 3000 has a planar heater 100 positioned at the inside surface of fuser drum 600. The power of the planar heater 100 is controlled by the PWM heater controller 260 discussed earlier. As shown in FIG. 7B, the fuser drum 600 heats ink (or toner) that has been applied to printing paper P, in order to fuse the ink or toner. Through PWM control as described in relation to FIGS. 5 and 6A-6B, the temperature of this fuser drum unit 3000 will also be quickly and accurately brought to the target temperature, and maintained close to the target temperature.

Figure 8:
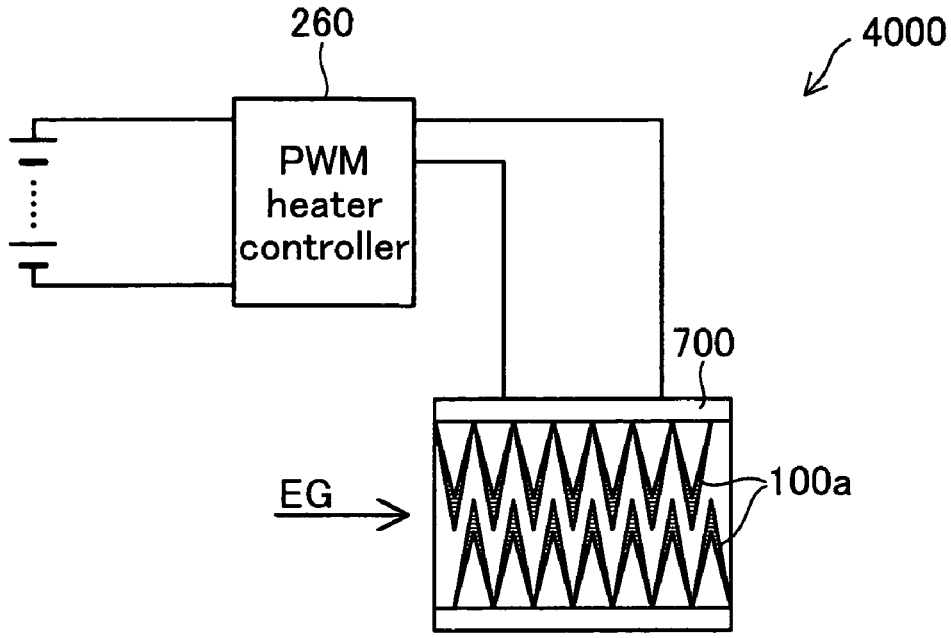
FIG. 8 shows the configuration of an exhaust gas purification unit for automotive use, pertaining Embodiment 4 of the invention.

FIG. 8 is an illustration depicting the configuration of an exhaust gas purification unit for automotive use, pertaining to a fourth embodiment of the present invention. This exhaust gas purification unit 4000 is installed midway along the exhaust line of a vehicle, and has a catalytic purification unit 700 for purifying exhaust gases EG. A planar heater 100*a* for heating the catalyst is installed inside the catalytic purification unit 700. In order to raise the temperature of the catalyst inside the catalytic purification unit 700 as uniformly as possible, the planar heater 100*a* has been bent into a peak-and-valley configuration. The power of the planar heater 100*a* is controlled by the PWM heater controller 260 discussed earlier. Heating by the planar heater 100*a* takes place primarily at startup of the vehicle. The reason is that since the catalyst is at low temperature at the time of vehicle startup, it cannot efficiently carry out purification while still cold. On the other hand, after there is a sufficient supply of high temperature exhaust gases EG from the engine, the catalyst will be heated sufficiently by the exhaust gases EG so heating by the planar heater 100*a* will become substantially unnecessary. Accordingly, in the exhaust gas purification unit 4000, the catalyst will be heated up rapidly by the planar heater 100*a* during startup of the vehicle. It is possible for this rapid heating to be carried out by the PWM heater controller 260 as described with reference to FIG. 6.

Figure 9:
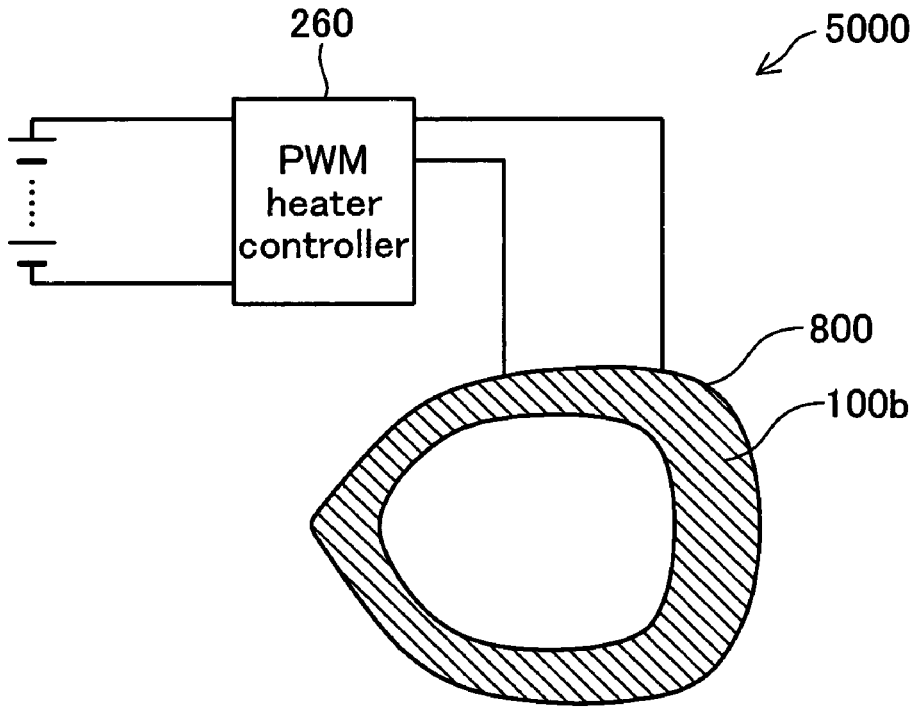
FIG. 9 shows the configuration of toilet seat heating unit pertaining to a fifth embodiment of the present invention.

FIG. 9 is an illustration depicting the configuration of toilet seat heating unit pertaining to a fifth embodiment of the present invention. This toilet seat heating unit 5000 has a planar heater 100*b* installed inside a toilet seat 800. The power of the planar heater 100*b* is controlled by the PWM heater controller 260. This toilet seat heating unit 5000 normally assumes a standby mode without heating by the heater, but will rapidly heat the toilet seat 800 with the planar heater 100*b* immediately after a user has entered the bathroom, for example. This avoids unnecessary power consumption during idle periods. Entry of the user into the bathroom may be detected, for example, by installing a person sensor in the bathroom, and designing the unit to initiate operation by the PWM heater controller 260 in response to an output signal from the sensor.

Figure 10:
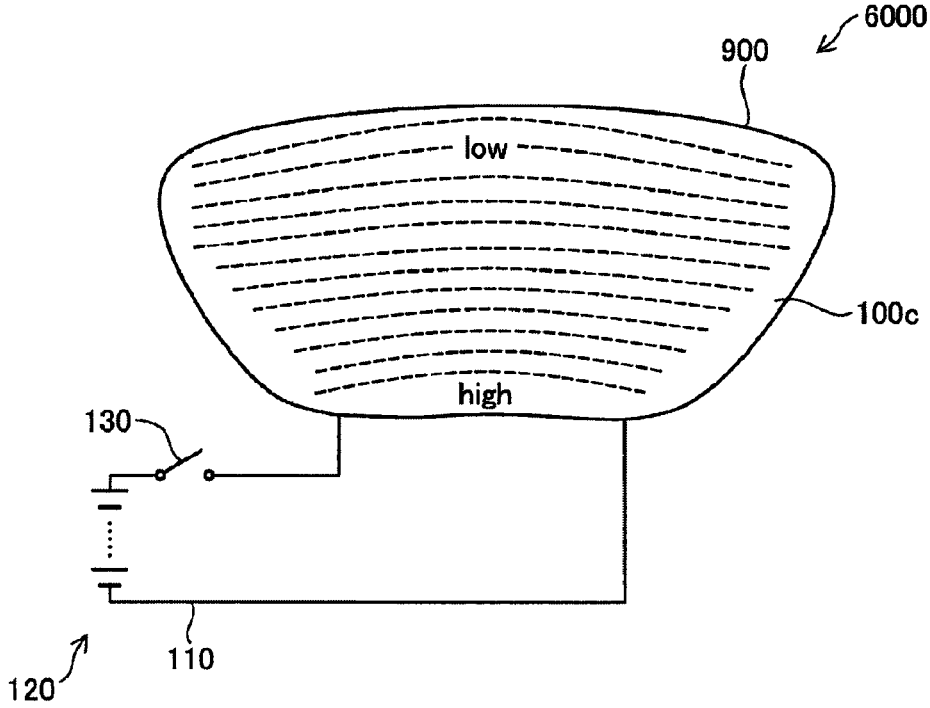
FIG. 10 shows the configuration of an automotive windshield defroster unit pertaining to Embodiment 6 of the invention.
Figure 11:
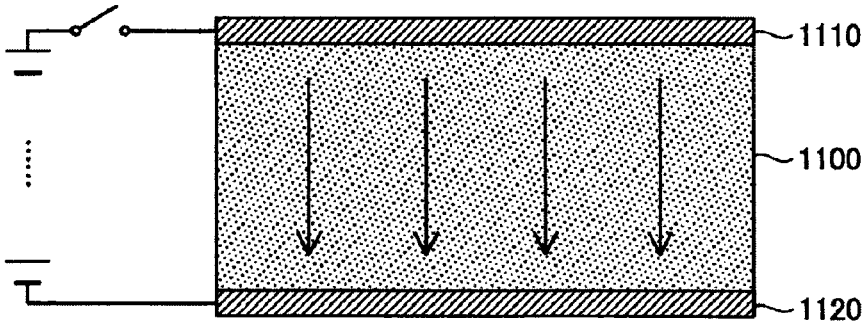
Fig.11 Prior Art
FIG. 11 shows a conventional planar heater.

FIG. 10 is an illustration depicting the configuration of an automotive windshield defroster unit pertaining to a sixth embodiment of the present invention. This windshield defroster unit 6000 has a transparent planar heater 100*c* installed within the windshield 900 of the vehicle. The planar heater 100*c* is connected to a power supply 120 via two lead wires 110, with a switch 130 provided to one of the lead wires 110. The two lead wires 110 are each connected to the planar heater 100*c* at the bottom edge of the windshield 900. Since this defroster unit 6000 employs a transparent planar heater 100*c* it will not obstruct the driver's field of view, while being able to quickly melt away frost adhering to the windshield 900.

The foregoing description of the present invention based on certain preferred embodiments is provided for illustration only and not for the purpose of limiting the invention, and various modifications such as the following can be made herein without departing from the spirit and scope of the invention.

The planar heater according to the present invention is applicable in devices or apparatuses of various kinds besides the devices and apparatuses discussed hereinabove. It is possible for the shape of the planar heater to be modified as needed for the particular device in which it will be implemented.

The device for controlling the planar heater is not limited to the switch 130 (FIG. 1) or the PWM heater controller 260 (FIG. 4), and would be possible to use various other types of control devices.

What is claimed is:

1. A device comprising a planar heater, the planar heater including:

an insulating substrate;

an electric conductive film disposed on the substrate, an entirety of the electric conductive film having a planar sheet-like form, the electric conductive film having a substantially rectangular shape with four sides;

a plurality of electrodes attached to one of the four sides of the electric conductive film while no electrodes are attached to the other three of the four sides; and an insulating film covering the electric conductive film, wherein the electric conductive film is formed of material having a resistance temperature coefficient of 420 ppm/° C. or higher at normal temperature, and wherein, upon turning on the planar heater, a portion of the electric conductive film proximate the one side heats up due to electric current flow between the plurality of electrodes, the heating up causing an electrical resistance of the portion to increase which subsequently causes the electric current flow to progressively flow through and heat up other portions of the electric conductive film which are continuously more remote from the one side.

2. The device of claim 1, wherein the electric conductive film is formed of material having resistance of 4.8 μΩ-cm or higher at normal temperature.

3. The device of claim 2, wherein the electric conductive film is formed of tungsten.

4. The device according to claim 1, wherein the planar heater is transparent.

* * * * *